United States Patent [19]

Grishchenko

[11] Patent Number: 4,838,147

[45] Date of Patent: Jun. 13, 1989

[54] PRESSURE FLUID ACTUATOR

[76] Inventor: Grigory Grishchenko, 76 Surrey La., River Edge, N.J. 07661

[21] Appl. No.: 148,557

[22] Filed: Jan. 26, 1988

[51] Int. Cl.[4] ..... F01B 29/00

[52] U.S. Cl. ..... 92/88; 92/89; 92/90; 92/85 R

[58] Field of Search ..... 92/88, 89, 90, 91, 92, 92/137, 140, 117 R, 13.6

[56] References Cited

U.S. PATENT DOCUMENTS 4,724,744 2/1988 Rosengren ..... 92/88

FOREIGN PATENT DOCUMENTS 0068088 1/1983 European Pat. Off. ..... 92/88
2404244 8/1975 Fed. Rep. of Germany ..... 92/137
2718528 11/1978 Fed. Rep. of Germany ..... 92/90
2816546 10/1979 Fed. Rep. of Germany ..... 92/90
3302444 7/1984 Fed. Rep. of Germany ..... 92/90
0928071 5/1982 U.S.S.R. ..... 92/89
1358361 7/1974 United Kingdom ..... 92/90

*Primary Examiner*—Robert E. Garrett
*Assistant Examiner*—Thomas Denion

[57] ABSTRACT

A pressure fluid actuator having an elongated tubular chamber, a slot extending longitudinally along the wall of the chamber, a flexible hose member within the chamber and an improved reciprocally movable bracket having an upper portion extended through said slot and connected to a workpiece, which is slidable along the exterior of said chamber, and a lower portion having a rotatably mounted shaft with a pair of rollers for engagement with said flexible hose member to create a reciprocal movement of the bracket.

3 Claims, 3 Drawing Sheets

PRESSURE FLUID ACTUATOR

REFERENCES CITED

U.S. Pat. Nos.=3,820,446=6/1974=Granbom,=92/88=4,373,427=9/1984=Smith, 92/88,=4,545,290=10/1985,=Lieberman,=92/88.

BACKGROUND OF THE INVENTION

The present invention relates to a fluid pressure rodless cylinder of the kind having a cylinder with longitudinally extended slot, an external workpiece with a transfer member adapted to move along the slot and connected to a piston reciprocally movable within the cylinder.

Rodless pressure cylinders have existed in industry for many years. The advantage of such cylinders is that the cylinder length only insignificantly exceeds the stroke length. Rodless cylinders in general include a slotted cylindrical fluid pressure chamber and means for transferring the reciprocal movement of the piston to an external workpiece. In such cylinders this means normally includes a transfer bracket connected directly with the workpiece and piston, and a seal member along the length of the cylinder. Such a seal member is needed to prevent the fluid pressure from escaping the cylinder through the slot passed by the transfer bracket.

Of the prior attempts made to improve sealing, one device is shown in U.S. Pat. No. 3,820,446 and contemplates the use of a flat sealing member having magnetic properties. The sealing member is retained in sealing position by a number of magnetic elements embedded within the non-magnetic cylinder wall. A second device is shown in U.S. Pat. No. 4,373,427. This patent contemplates that the cylinder wall will be made of material having magnetic properties and the sealing member would have a portion constructed of a rubberized magnet. Both of these devices employ magnetic properties of the construction materials for sealing the longitudinal cylinder slot. A third sealing structure is shown in the U.S. Pat. No. 4,545,290. The device of this patent contemplates that the sealing member will be constructed of a flexible material and would include sealing portion for creating a seal against the inner side wall and support portion for insertion within the cylinder slot to retain the sealing member within the slot during an absence of pressure within the cylinder.

While all of the above mentioned devices provided satisfactory performance, there are ways to improve certain features of fluid pressure actuation capabilities at a reduced cost. Efforts are being made to construct a fluid pressure actuator of the rodless type without a sealing member. Further efforts are also being made to improve fluid power consumption and wearability by decreasing friction forces of the moving parts.

SUMMARY OF THE INVENTION

The present invention relates in common to a fluid pressure actuator of the rodless type having an elongated actuator chamber with an elongated slot, an elongated flexible hose within said chamber and a reciprocally movable force transfer bracket. The force transfer bracket structure of the present invention in engagement with said flexible hose provides for significantly improved working capabilities with a practically 'leak-proof' condition. The prevent invention also includes improved means for reducing friction during reciprocal movement of the force transfer bracket along the longitudinal axis of the actuator. Finally, the reciprocally moving means of the present invention embodies a comparably low cost structure.

More particularly, the reciprocally moving means are provided in the form of a force transfer bracket having a rotatably secured shaft and a portion extending through the slot for connection to the workpiece. Means are also provided in the fluid pressure actuator of the present invention for driving a force transfer bracket within the actuator chamber structure. These means include a pair of rollers which are secured with a said shaft for providing reciprocal motion by a flexible hose member. Means are also provided for guiding a force transfer bracket along the actuator chamber structure. In the preferred embodiment these means are constructed in the form of a pair of radial bearings which are arranged at both ends of said shaft for a contact with corresponding surfaces of the actuator chamber structure. Also, a pair of longitudinal groove is provided on both exterior sides of the actuator chamber structure to guide an actuator workpiece during its movement. Means are also provided in the form of a curved surface of the end fitting for aiding the inflation of the flexible hose member.

The preferred embodiment of the present invention also contemplates the use of dust bands or the like to cover the interior of the fluid pressure actuator.

Accordingly, it is an object of the present invention to provide a fluid pressure actuator of the rodless type having an internal flexible hose member for improved working capabilities by eliminating the need for a sealing member.

Another object of the present invention is to provide a fluid pressure actuator having an improved means for reducing friction during reciprocal movement of the workiece.

A further object of the present invention is to provide an improved end fitting configuration for flexible hose member.

These and numerous other objects and advantages of the present invention will become readily apparent from the following drawings, the description of the preferred embodiment and the claims.

DESCRIPTION OF THE PREFERRED EMBODIMENT

Figure 1:
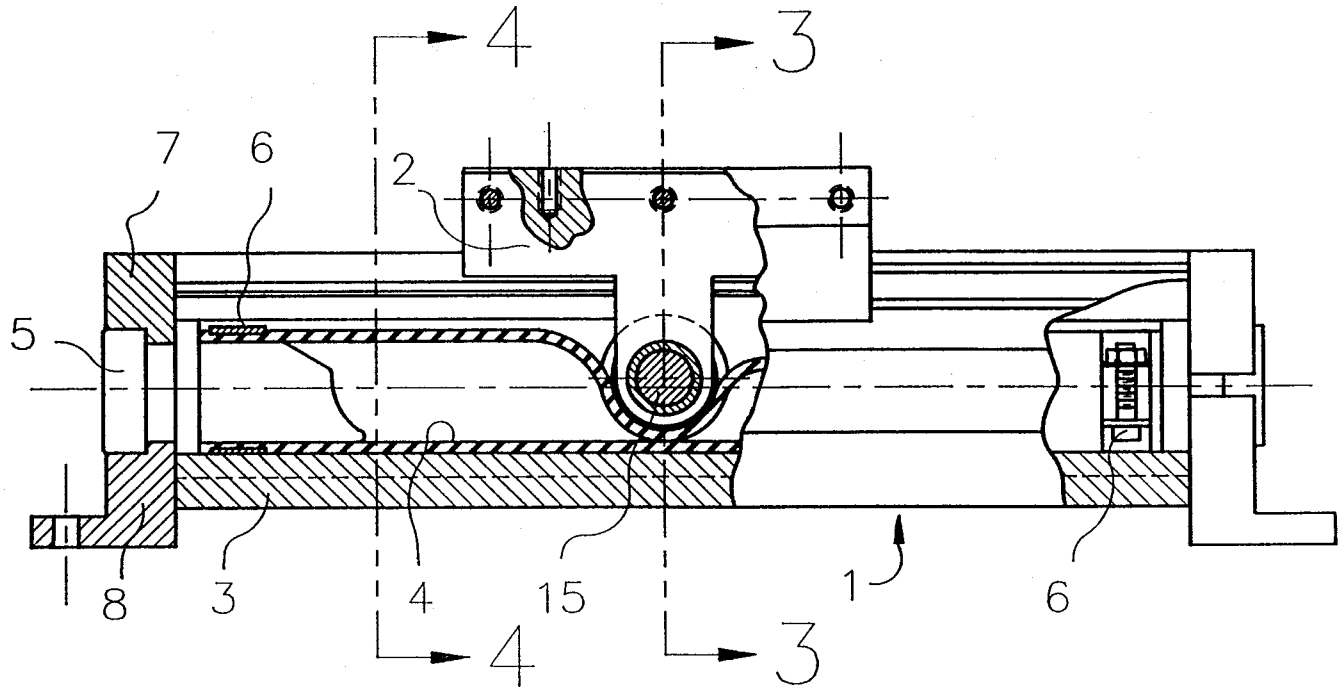
FIG. 1 shows substantially a longitudinal section through a pressure fluid actuator according to the invention.

As appears from FIG. 1, an actuator 1 includes a force transfer bracket 2 disposed within the interior of the actuator chamber 3 and adapted for reciprocal movement. Further, the actuator is provided with means for its operation, such as flexible hose member 4 having an object of converting fluid pressure (air or oil) into the transfer bracket movement. These means also include end fittings 5, hose clamps 6, end plates 7 and end brackets 8. In the wall of the actuator chamber structure 3 there is provided an elongated slot 9 (FIG. 3), out of which projects a transfer bracket 2 which in the embodiment shown comprises an upper portion 10 which is joined with guide plates 11 and 12 with threaded fasteners 13, and a lower portion 14 which is adapted for carrying a shaft 15. This shaft 15 is rotatably mounted in the lower portion 14 which includes a support bearing from a material with the low coefficient of friction, for example brass, plastic or the like, in the form of thin wall bushing 16.

The means for converting fluid pressure into reciprocal movement also includes the rollers 17 and 18, which are secured on the shaft 15 with pins 26. Each of the rollers 17 and 18 is generally cylindrical with a cylindrical surface for engagement with the hose member 4.

Figure 3:
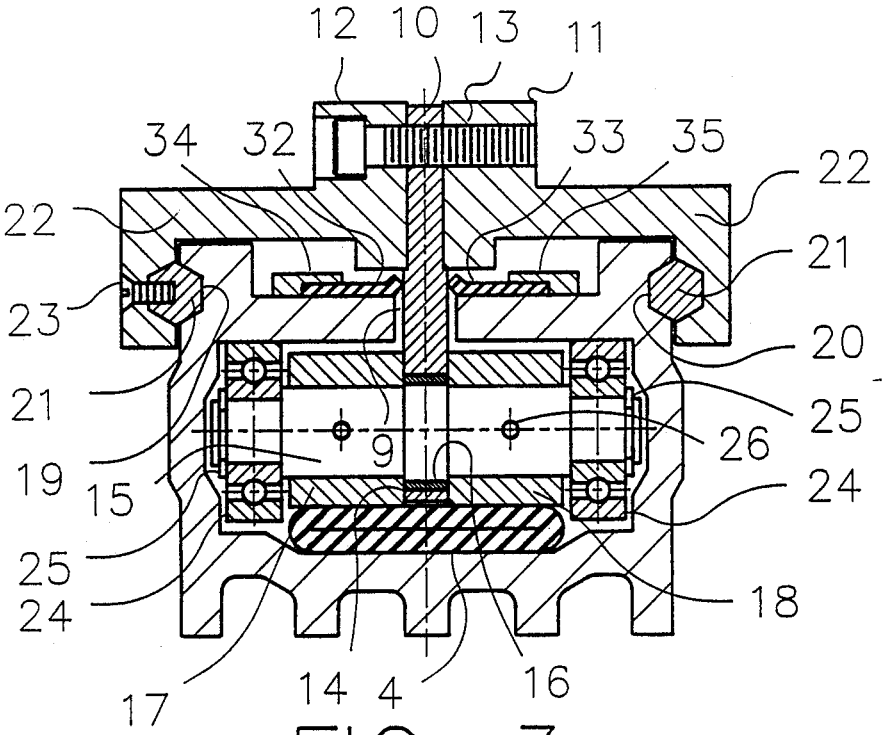
FIG. 3 shows a section along the line 3—3 in FIG. 1.
Figure 4:
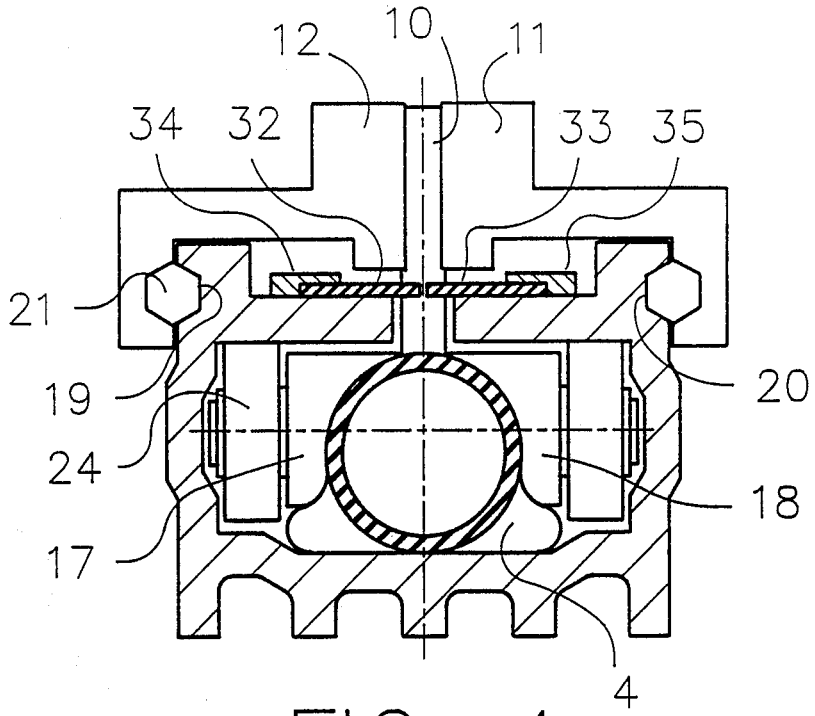
FIG. 4 shows a section along the line 4—4 in FIG. 1.

As shown in FIGS. 3 and 4, means also provided for guiding an actuator workpiece, which is constructed from two guide plates 11 and 12 fastened to the upper portion 10 of the transfer bracket 2, along the actuator chamber 3. Each of the guide plates 11 and 12 is formed with a lip portion 22 having a hexagonal bearing rod 21 fixedly secured with a threaded fastener 23. In the preferred embodiment the exterior sides of the actuator chamber 3 are provided with the opposed longitudinal grooves 19 and 20 extending the entire length of the actuator 1.

The bearing rods 21 are intended to mate with said grooves 19 and 20 as shown in FIG. 3 and 4 so as to assist in guiding the workpiece along the actuator chamber 3.

Figure 2:
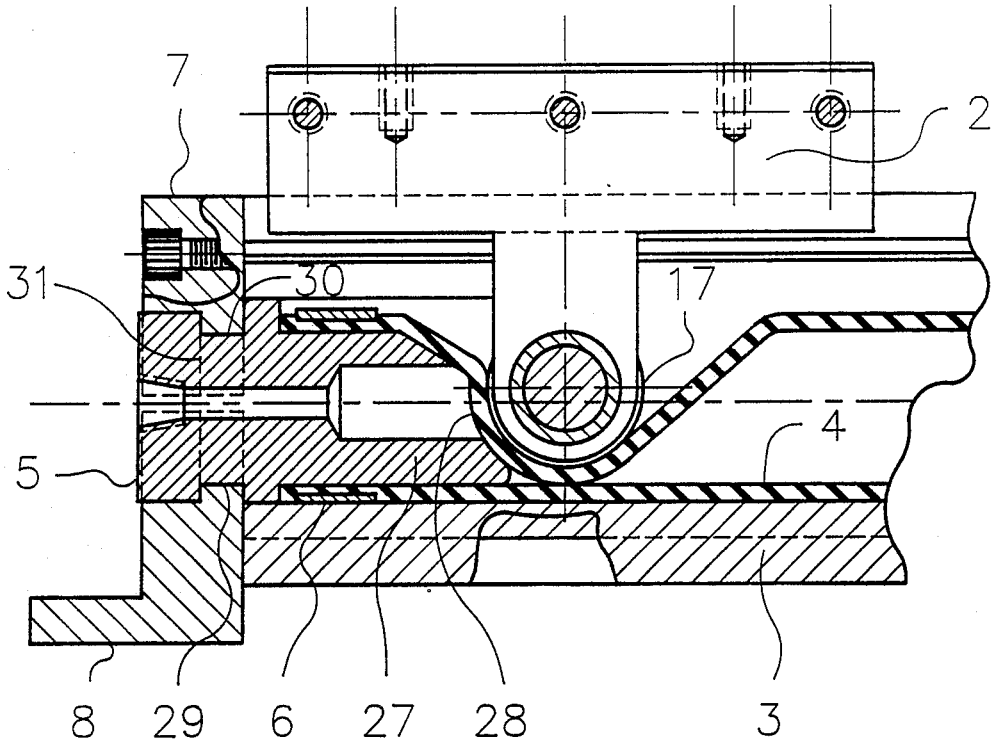
FIG. 2 shows a longitudinal section through an embodiment of the invention.

As shown in FIGS. 3 and 4, means are also provided for support and guiding the interior portion 14 of the transfer bracket 2 within the actuator chamber structure 3. This means includes a pair of radial bearings 24 adapted on both ends of the shaft 15 with retaining rings 25. With reference to FIG. 2, these radial bearings 24 support and guide the transfer bracket 2 during its reciprocal movement caused by engagement of the rollers 17 and 18 with the inflating hose member 4.

At the embodiment in FIG. 2 showing a partial longitudinal section through the end fitting 5, the end plate 7, the end bracket 8 and the hose member 4, the neck portion 27 of the end fitting 5 constitutes a seat for the rollers 17 and 18 of the transfer bracket 2. FIG. 2 further shows the end fitting 5 at the end position of the actuator 1 adapted to supply drive fluid to the interior of the hose member 4 having its end portion clamped around the neck portion 27 of the end fitting 5 with a hose clamp 6. It should be noted that the surface 28 of the end fitting 5 facing the interior of the hose member 4 is curved in such a way that its center of curvature coincides with the center of the rollers 17 and 18 of the transfer bracket 2 at its end position as shown in FIG. 2. The end plate 7 and end bracket 8 are secured to the actuator chamber 3, having an interlocking engagement with end fitting 5 with their retaining portions 29 and 30 and end fitting groove 31.

As shown in FIGS. 3 and 4, means are also provided for protecting the interior of the actuator from dust. This means includes dust bands 32 and 33, which are normally constructed of compressible material such as a natural or synthetic rubber and secured to the actuator chamber structure 3 with clamping plates 34 and 35. These bands 32 and 33 bend out when engaged with the lower portion 14 of the transfer bracket 2 during its reciprocal movement as illustrated best in FIG. 3. With reference to FIG. 4, as the transfer bracket 2 moves along the actuator 1, the dust bands 32 and 33 return to normally closed position behind it.

Having described the preferred embodiment of the present invention in detail, the operation of the actuator can be understood as follows. As fluid pressure is introduced into the pressure compartment of the hose member 4 on either side of the actuator 1 through end fitting 5, the hose member 4 will begin to inflate, thereby creating a displacement effect for the rollers 17 and 18 of the transfer bracket 2 causing said bracket to move in a direction opposite the fluid pressure introduction side. The movement of the transfer bracket 2 will be guided along actuator chamber structure 3 with guide plates 11 and 12 and the bearing rods 21. Also support and additional guidance is provided with a pair of radial bearings 24 during the movment of the transfer bracket 2, when rollers 17 and 18 are subjected to displacing forces from inflating hose member 4.

The embodiments shown are only examples of the application of the invention. The invention is not restricted to these embodiments, and various changes could be made without deviating from its spirit. The actuator 1, as mentioned, may have a cross-sectional shape other than shown and may also have two pairs of rollers adapted on the transfer bracket 2 in the longitudinal direction.

I claim:

1. A pressure fluid actuator comprising:

an elongated tubular chamber having a side wall and a slot extending longitudinally through said side wall;

a hose member attached at its respective ends to the inner portion of said tubular chamber and having its ends portions connected with end fittings in such a way that curved surfaces of said end fittings are facing the interior of said hose member;

a transfer bracket reciprocally movable within said tubular chamber and extending through said slot of the actuator;

force tranfser means including a shaft rotatably mounted in the lower portion of said transfer bracket and having a pair of rollers for displacing engagement with said hose member and a pair of radial bearings disposed on both ends of said shaft for engagement with inner surface of said tubular chamber and adapted coaxially with said rollers on said shaft for causing opposite directions of rotation of said rollers and outer rings of said radial bearings;

means for supporting and guiding said transfer bracket during its movement including a pair of guide plates fastened to the upper portion of the transfer bracket and having hexagonal bearing rods for guiding said plates along retaining grooves constructed on the outside wall of said tubular chamber; and means facilitating the cushioning of said transfer bracket and comprising a curved portion of said end fitting so that its center of curvature coincides with the center of said rollers at the end position of said transfer bracket.

2. The actuator of claim 1 wherein said hose member is constructed of a flexible polymeric material to permit inflation under pressure.

3. The actuator of claim 1 wherein said hose member has its its end portion clamped around the neck of the end fitting with a hose clamp.

* * * * *